US010594059B1

(12) United States Patent
Bieda et al.

(10) Patent No.: US 10,594,059 B1
(45) Date of Patent: Mar. 17, 2020

(54) FEED-THROUGH TERMINAL BLOCK MODULE

(71) Applicant: Phoenix Contact Development and Manufacturing, Inc., Middletown, PA (US)

(72) Inventors: James R. Bieda, Harrisburg, PA (US); Steve Lytle, Palmyra, PA (US)

(73) Assignee: Phoenix Contact Development and Manufacturing, Inc., Middletown, PA (US)

( * ) Notice: Subject to any disclaimer, the term of this patent is extended or adjusted under 35 U.S.C. 154(b) by 0 days.

(21) Appl. No.: 16/245,840

(22) Filed: Jan. 11, 2019

(51) Int. Cl.
*H01R 9/26* (2006.01)
*H01R 9/24* (2006.01)
*H01R 13/703* (2006.01)

(52) U.S. Cl.
CPC ..... *H01R 9/2408* (2013.01); *H01R 9/2491* (2013.01); *H01R 13/7033* (2013.01); *H01R 13/7034* (2013.01)

(58) Field of Classification Search
CPC ..... H01R 9/2408; H01R 13/7034; H01R 13/7033; H01R 9/2491
USPC ..... 439/717, 715, 721, 722, 723
See application file for complete search history.

(56) References Cited

U.S. PATENT DOCUMENTS 3,860,314 A 1/1975 Vandiveer et al.
6,848,951 B1 * 2/2005 Bechaz ..... H01R 9/2491 439/716
7,666,037 B2 2/2010 Diessel
9,153,916 B2 10/2015 Schloo et al.
2008/0106266 A1 * 5/2008 Diessel ..... H01R 9/2616 324/415
2014/0329397 A1 * 11/2014 Schloo ..... H01R 9/2491 439/188
2015/0147909 A1 * 5/2015 Gebhardt ..... H01R 9/2408 439/574
2016/0291058 A1 * 10/2016 Ostmeier ..... H01R 13/7034
2018/0261934 A1 9/2018 Kloppenburg et al.
2018/0269636 A1 * 9/2018 Schyrocki ..... H01R 9/2491
2019/0165511 A1 * 5/2019 Werner ..... H01R 9/2408

OTHER PUBLICATIONS

Marathon Special Products, Product Data Sheet, Nov. 7, 2007, 3 pages.

* cited by examiner

*Primary Examiner* — Abdullah A Riyami
*Assistant Examiner* — Nelson R. Burgos-Guntin
(74) *Attorney, Agent, or Firm* — Hooker & Habib, P.C.

(57) ABSTRACT

A feed-through terminal block module includes first and second electrical terminals, a first current bar, and a second current bar, the terminals and current bars in a terminal housing. The first current bar permanently electrically connects the first and second terminals. The first current bar includes a first contact portion of the module. The second current bar includes a second contact portion of the module and a third contact portion of the module. A removable contact plug is inserted into the housing to selectively electrically connect the first and second contact portions. Removable bridge pins or a bridging current bar electrically connects the third contact portions of adjacent modules when modules are placed side-by-side to form a terminal block.

24 Claims, 13 Drawing Sheets

FEED-THROUGH TERMINAL BLOCK MODULE

FIELD OF THE DISCLOSURE

The disclosure relates generally to terminal block modules having a pair of electrical terminals for connecting electrical lines, and in particular to feed-through terminal block modules, and to terminal blocks assembled from the feed-through terminal block modules.

BACKGROUND OF THE DISCLOSURE

Current transformers are attached to the respective lines of a three-phase power line and connected to system relays that can take the power line off-line in the event of a fault condition.

When it is necessary to disconnect the current transformers from the relays for system maintenance, each current transformer positive must be shorted to the current transformer negative (or to ground) to prevent current transformer damage. The current transformers may be attached to a shorting block that protects the current transformers by enabling the current transformers to be shorted to neutral or ground when disconnected from the relays.

Shorting blocks however may expose arcing potentials. Protective gear is worn by maintenance personnel to reduce the risk of electrical shock when accessing the shorting block to disconnect or reconnect the current transformers.

There is a need then for an improved shorting block that reduces the risk of electrical shock to maintenance personnel.

SUMMARY OF THE DISCLOSURE

Disclosed in embodiments is a feed-through terminal block module and terminal block formed from multiple feed-through terminal block modules. The terminal block in embodiments is a shorting block usable to protect current transformers while reducing the risk of electrical shock to maintenance personnel.

A feed-through terminal block module in accordance with the disclosure includes first and second electrical terminals, a first current bar, and a second current bar, the terminals and current bars in a terminal housing. The first current bar permanently electrically connects the first and second terminals. The second current bar is space away from the first current bar and is normally not electrically connected to the first current bar.

The first current bar includes a first contact portion of the module. The second current bar includes a second contact portion of the module and a third contact portion of the module.

The terminal housing has an opening aligned with the first and second contact portions that receives a contact plug inserted into the housing. The contact plug includes an electrical contact that, when fully inserted into the terminal housing simultaneously engages the first and second contact portions and thereby electrically connects the first current bar and the second current bar.

The entire electrical contact of the contact plug may be inside the terminal housing before making electrical contact with the first current bar to reduce the risk of inadvertent electrical shock of a user.

A number of feed-through terminal block modules may be placed side by side to form a feed-through terminal block. The terminal housing of the disclosed feed-through terminal block module further includes an additional opening or openings for a bridge pin or bridging current bar to engage and electrically connect the third contact portions of adjacent modules of the terminal block.

Other objects and features of the disclosure will become apparent as the description proceeds, especially when taken in conjunction with the accompanying drawing sheets illustrating one or more illustrative embodiments.

DETAILED DESCRIPTION

Figure 1:
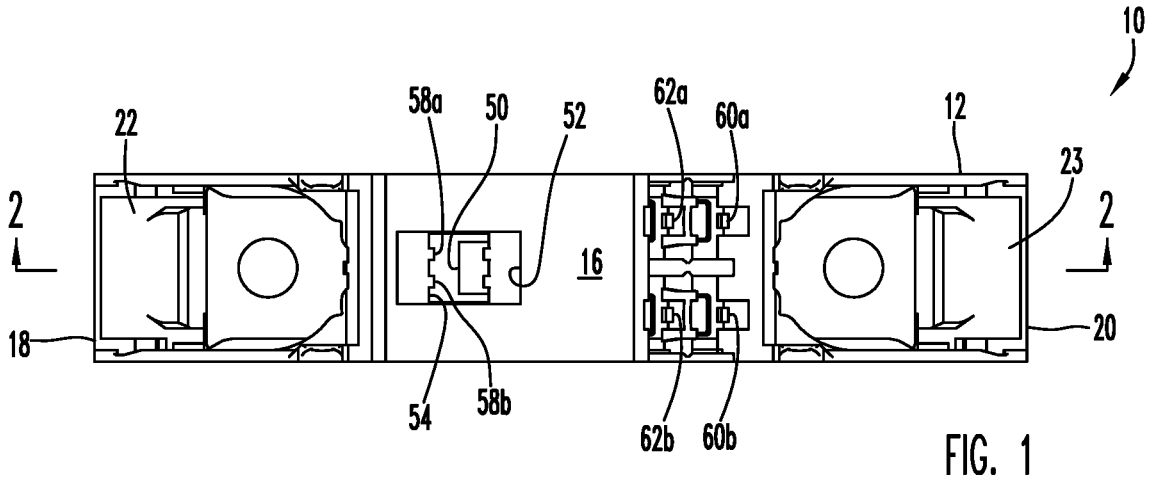
FIG. 1 is a top view of a first-embodiment of the disclosed feed-through terminal block module.
Figure 2:
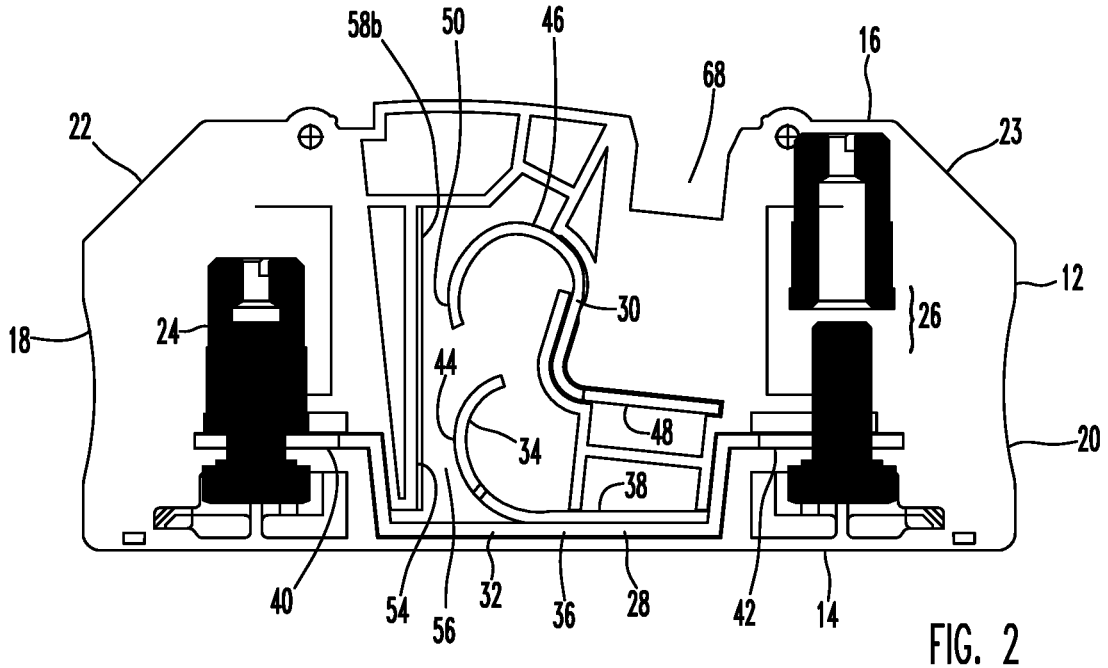
FIG. 2 is a vertical sectional view taken along lines 2-2 of FIG. 1.
Figure 3:
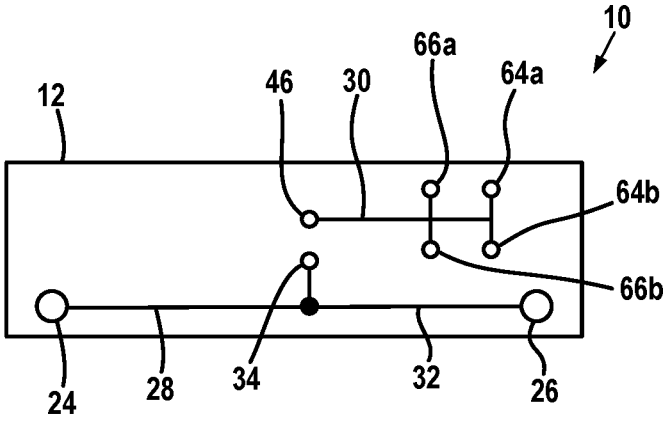
FIG. 3 is an electrical schematic view of the feed-through terminal block module shown in FIG. 1.

FIGS. 1-3 illustrate a first embodiment of a feed-through terminal block module 10 in accordance with this disclosure. The module includes a terminal housing 12 made of an insulating plastic. The terminal housing has a bottom wall 14, a top wall 16, and opposed end walls 18, 20 connecting the top and bottom walls. The illustrated bottom wall is flat for placement against a cabinet wall or the like. In other embodiments the bottom wall is designed for mounting the module on a DIN rail or other mounting structures. The top wall has a pair of flat panel portions having outer surfaces 22, 23 that can be used for attaching labels.

The terminal housing bottom wall 14, housing top wall 16, housing end wall 18, and housing end wall 20 together define an interior volume of the housing. Disposed in the interior of the terminal housing 12 is a first electrical terminal 24, a second electrical terminal 26, a first current bar 28, and a second current bar 30.

The first electrical terminal 24 is spaced apart from the second electrical terminal 26. The electrical terminals are located on opposite ends of the housing. The terminal housing has openings (not shown) which enable connecting external wires to the terminals. The illustrated terminals are screw terminals. In other embodiments other types of electrical terminals are used, including leg spring terminals, cage terminals, insulation-piercing terminals, and the like.

The first current bar 28 includes a feed-through portion 32 and a first contact portion 34 of the module 10. The first contact portion is permanently electrically connected to the feed-through portion.

The first current bar is formed of individual metal strips: a first metal strip 36 and a second metal strip 38. The metal strips are connected to one another and are electrically conductive with one another. The first metal strip forms the feed-through portion and the second metal strip including the first contact portion. The feed-through portion permanently connects the first electrical terminal 24 and the second electrical terminal 26 with one another. The first metal strip includes a first terminal end portion 40 and an opposite second terminal end portion 42 attaching the feed-through portion to the electrical terminals.

The first contact portion 34 is spaced away from the feed-through portion 32 towards the housing top wall 16. The first contact portion is formed on a free end of the second metal strip 38. The first contact portion is elastically displaceable and forms a resilient spring arm. The first contact portion includes a rounded contact nose 44.

The second current bar 30 is spaced away from the first current bar 28 towards the housing top wall 16. In the state of the module 10 shown in FIGS. 1-3 the second current bar is not electrically connected to the first current bar.

The second current bar 30 includes a second contact portion 46 of the module 10 and a third contact portion 48 of the module 10. The second contact portion is formed on a free end of the second current bar. The second contact portion is elastically displaceable and forms a resilient spring arm. The second contact portion includes a rounded contact nose 50.

The contact nose 50 is aligned with the contact nose 44, the contact noses being aligned along a vertical axis as viewed in FIG. 2 that is perpendicular to a horizontal axis defined by the first electrical terminal 24 and the second electrical terminal 26. The contact nose 44 and the contact nose 50 are selectively electrically connectable to one another by a contact plug (described below) inserted into the terminal housing 12.

The housing top wall 16 includes a through opening 52 that receives the contact plug inserted into the terminal housing. The terminal housing 12 includes an interior vertical wall 54 aligned with one side of the opening 52 that extends from below the opening 52 to near the feed-through portion 32. The lower contact nose 44 and the upper contact nose 50 each face the interior wall and are spaced apart from the wall by an air gap 56. The air gap extends along the vertical wall from the feed-through portion upwardly to the contact nose 44, upwardly beyond the contact nose 44 to the contact nose 50 and upwardly beyond the contact nose 50 to the upper end of the vertical wall. The vertical wall includes a pair of vertical ribs 58*a*, 58*b* extending the full height of the wall that extend into the air gap.

The third contact portion 48 is on an opposite end portion of the second current bar 30 spaced towards the end wall 20 from the first contact portion. The third contact portion is wider than the second contact portion and is shaped essentially as a flat plate that extends outwardly (in the direction perpendicular to the drawing sheet as viewed in FIG. 1) away from both lateral sides of the second contact portion. First and second pairs of through holes 60*a*, 60*b* and 62*a*, 62*b*4 are disposed outwardly of respective lateral sides of the second contact portion as can be seen in FIG. 1.

The material of the second current bar surrounding the through holes 60*a*, 60*b* and 62*a*, 62*b* define respective pairs of electrical contacts 64*a*, 64*b*, 66*a*, 66*b* (see FIG. 3). These electrical contacts of the third contact portion 48 enable the second current bar 30 to be selectively electrically connectable with a leg of a bridge pin (described below) inserted into one of the through holes 60, 62 and extending into the through hole associated with the contact.

The housing top wall 16 defines a housing recess 68 that extends towards the third contact portion 48. The recess receives a bridge pin inserted into the terminal housing 12. The housing top wall at the bottom of the recess includes through holes aligned with the holes 60, 62 to receive a leg or legs of a bridge pin inserted into the terminal housing.

Figure 4:
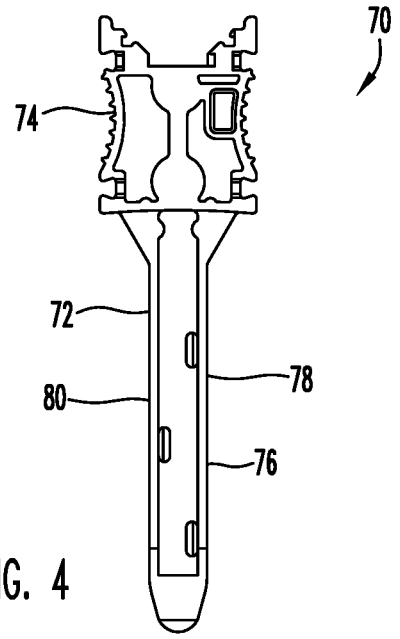
FIGS. 4 and 5 are front and side views respectively of a contact plug for use with the feed-through terminal block module shown in FIG. 1.
Figure 5:
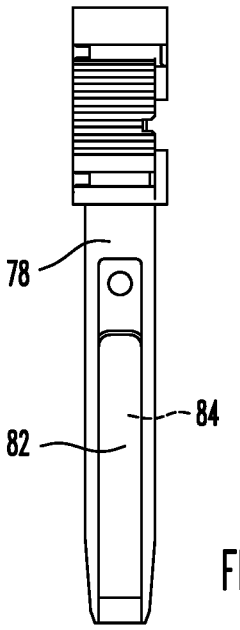

A contact plug 70 designed to selectively electrically connect the second current bar 30 with the first current bar 28 is shown in FIGS. 4 and 5. The contact plug includes a plug body 72 formed from an insulating material that includes a plug handle 74 and an elongate plug 76 extending away from the plug handle. The plug has a first plug side 78 and an opposite second plug side 80. Disposed on the first plug side 78 and recessed into the plug body is an elongate plug electrical contact 82 formed from a metal strip. The plug electrical contact 82 is spaced away from both the plug handle 74 and the free end of the plug. The surface of the first plug side 78 between the plug electrical contact 82 and the plug handle and between the plug electrical contact 82 and the free end of the plug is exposed. If desired a second plug electrical contact 84 identical to the plug electrical contact 82 can be placed and located in the same manner on the second plug side 80.

Figure 6:
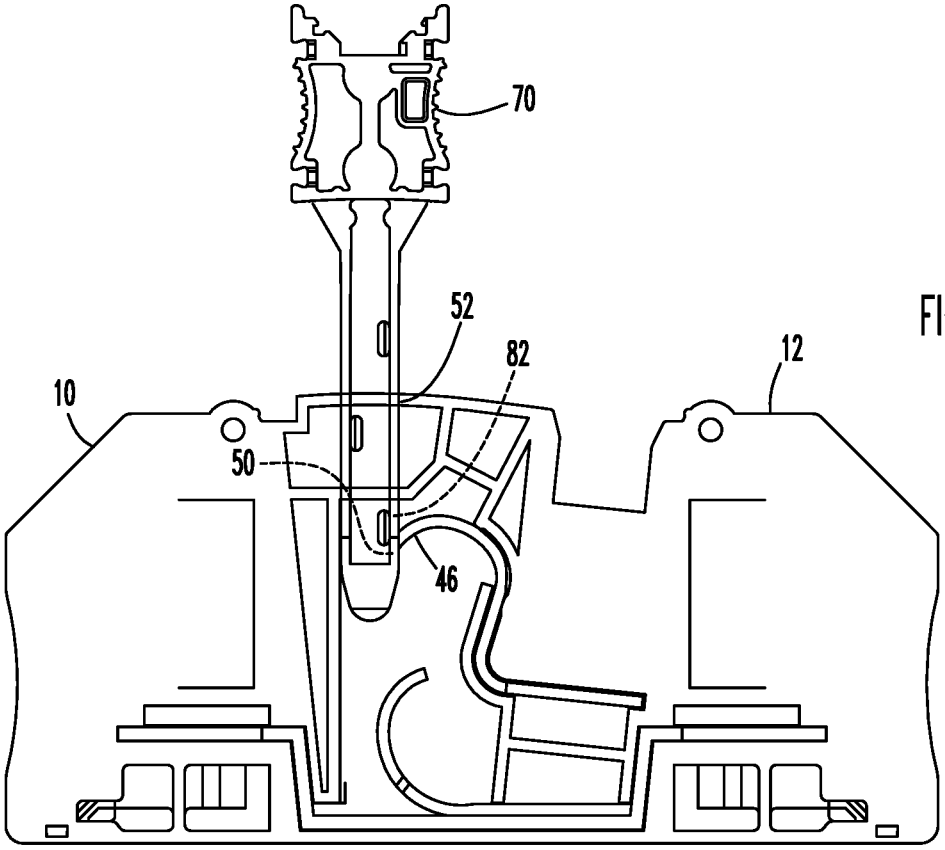
FIG. 6 is a view similar to FIG. 2 but with the contact plug partially inserted into the terminal housing.
Figure 7:
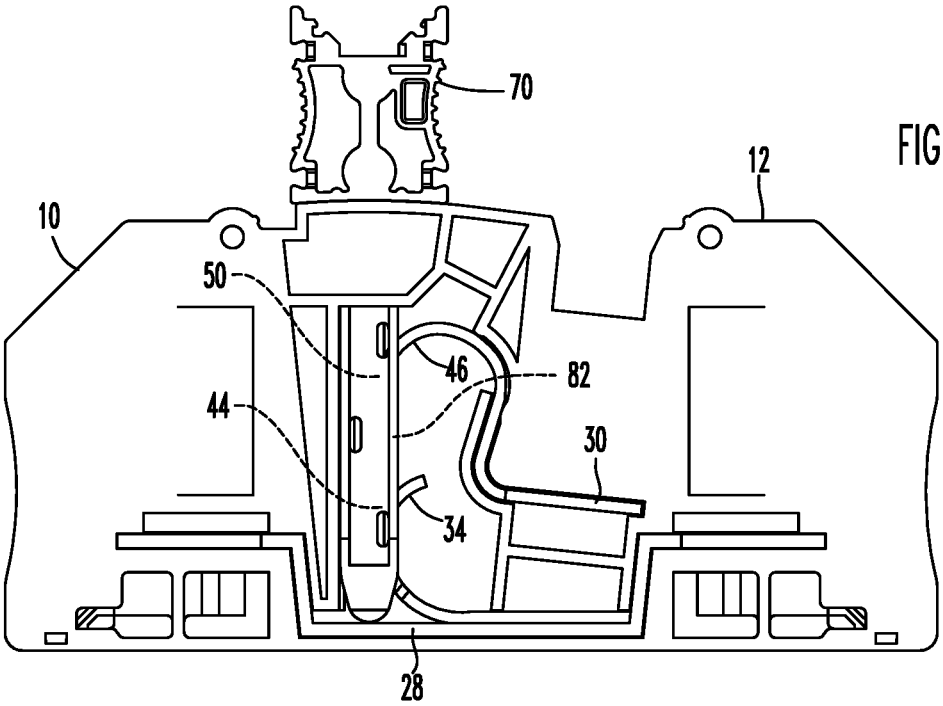
FIG. 7 is a view similar to FIG. 2 but with the contact plug fully inserted into the terminal housing.

FIGS. 6 and 7 illustrate insertion of the contact plug 70 into the terminal housing 12 of the module 10. To simplify the drawings, the electrical terminals are not shown in the figures.

FIG. 6 illustrates the contact plug 70 partially inserted into the terminal housing 12. The plug 76 is closely received through the housing opening 52 and enters into the air gap 56 adjacent the housing vertical wall 54 (to simplify the drawing, the wall ribs 58*a*, 58*b* are not shown). The wall and the wall ribs assist in locating and supporting the plug during insertion of the plug. As shown in FIG. 6, the plug electrical contact makes initial contact with the second contact portion 46 before reaching the first contact portion 34. The plug is sized to elastically deflect the second contact portion away from the housing vertical wall 54. The contact nose 50 makes reliable swiping electrical contact with the plug electrical contact 82. The spring force generated by the elastic deflection of the second contact portion and pressing the contact nose against the plug electrical contact maintains that reliable electrical contact between the contact plug and the second contact portion.

FIG. 7 illustrates the contact plug 70 in its fully inserted condition, that is, with the plug 76 essentially fully inserted into the terminal housing 12. The plug handle 74 is too large to pass through the housing opening 52 and resists further movement of the plug into the terminal housing when the contact plug has reached the fully inserted condition.

The plug electrical contact 82 continues to maintain electrical contact with the upper contact nose 50 as the plug moves from its position shown in FIG. 6 to the fully inserted position. Before the plug electrical contact 82 makes electrical contact with the first current bar 28, the plug electrical contact 82 (and the plug electrical contact 84 if present) are fully received into the interior of the terminal housing 12.

The plug contact then makes contact with the first contact portion 34 and elastically deflects the first contact portion away from the housing vertical wall 54. The contact nose 44 makes reliable swiping electrical contact with the plug electrical contact 82. The spring force generated by the elastic deflection of the first contact portion and pressing the contact nose 44 against the plug electrical contact maintains that reliable electrical contact between the contact plug and first contact portion.

As shown in FIG. 7, the plug electrical contact 82 electrically connects the first current bar 28 with the second current bar 30 through simultaneous electrical contact with the lower contact nose 44 and the upper contact nose 50. As a result, the first electrical terminal 24 and the second electrical terminal 26 are also electrically connected to the second current bar in parallel with the first contact bar.

Figure 8:
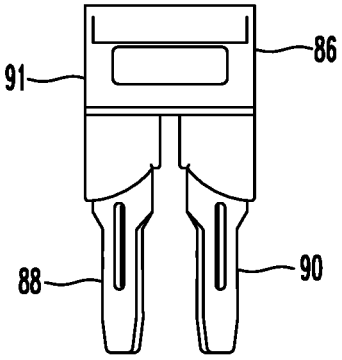
FIGS. 8 and 9 are front and side views of a bridge pin for use with the feed-through terminal block module shown in FIG. 1.
Figure 9:
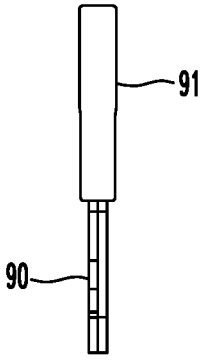

FIGS. 8 and 9 illustrate a bridge pin 86 having a leg designed to selectively electrically connect with the second current bar 30. The bridge pin includes a pair of spaced apart, exposed elongate metal legs 88, 90 electrically connected to one another and extending away from an insulated handle 91.

Figure 12:
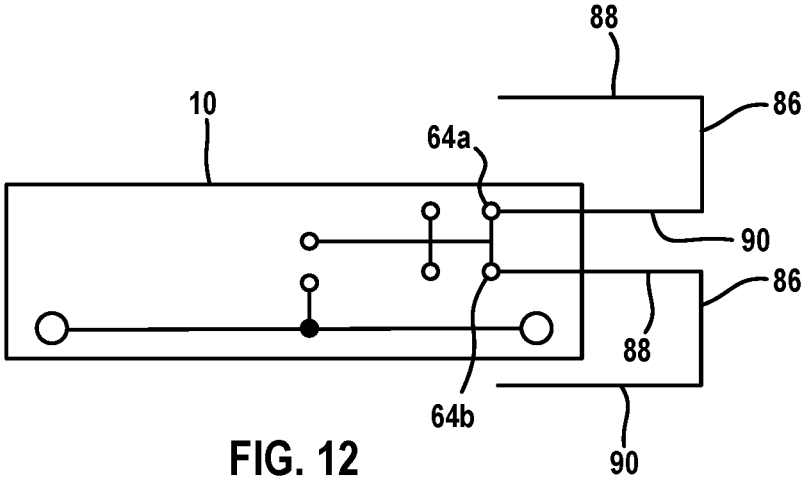
FIG. 12 is an electrical schematic view of the feed-through terminal block module shown in FIG. 1 with two bridge pins attached.
Figure 10:
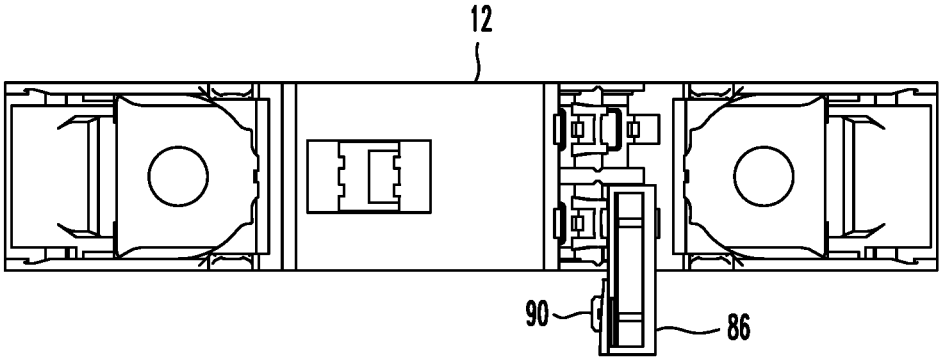
FIG. 10 is a view similar to FIG. 1 with a bridge pin inserted into the terminal housing.
Figure 11:
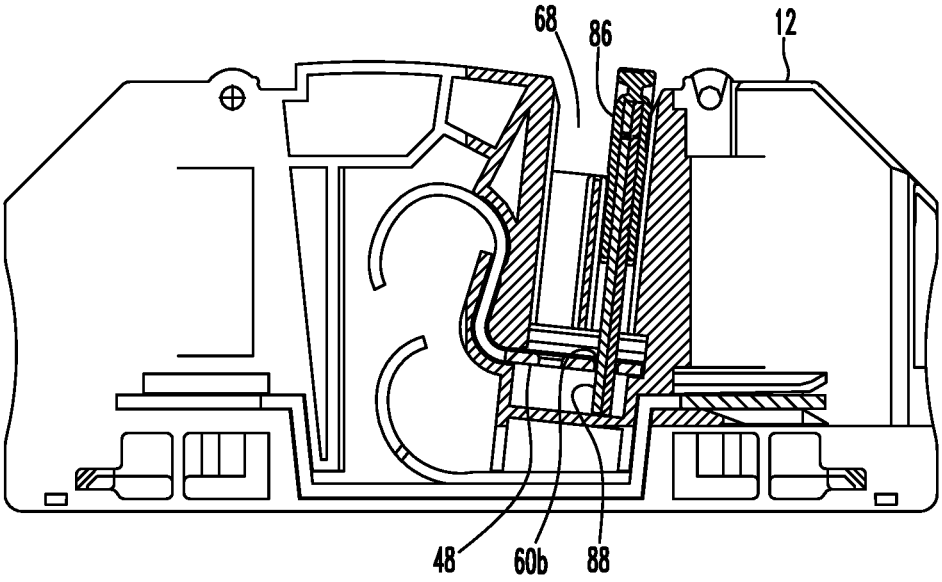
FIG. 11 is a view similar to FIG. 2 with a partial sectional view of the bridge pin inserted into the terminal housing.

FIGS. 10-12 illustrate the bridge pin 86 inserted into the terminal housing 12. The bridge pin is received in the housing recess 68 with the leg 88 inserted through a hole in the recess and extending into and through the contact hole 60*b*. The other leg 90 is outside of the module as shown. The leg 88 makes reliable electrical contact with the contact 64*b* of the third contact portion 48 thereby electrically connecting the bridge pin legs with the second current bar.

FIG. 12 illustrates the state of the module 10 with a second bridge pin 86*a* inserted into the terminal housing 12. The leg 90 of the second bridge pin is making electrical contact with the contact 64*a* of the third contact portion 48. The second bridge pin is thereby electrically connected to the second current bar in parallel with the first bridge pin 86.

As illustrated in FIGS. 6, 7, 10, 11 a contact pin and bridge pin can be inserted into the terminal housing through the housing top wall 16. The module 10 can be mounted on a wall or inside a cabinet with only the portion of the top wall 16 defining the housing opening 52 and the housing recess 68 exposed. This enables a user to insert or extract a contact plug or insert or extract a bridge pin with access only to the front portion and not to "hot" connections that pose the risk of electrical shock through inadvertent contact. Furthermore, the plug electrical contact(s) are fully inserted into the terminal housing before the contact(s) make electrical contact with the first current bar, further reducing the risk of inadvertent user shock.

Figure 13:
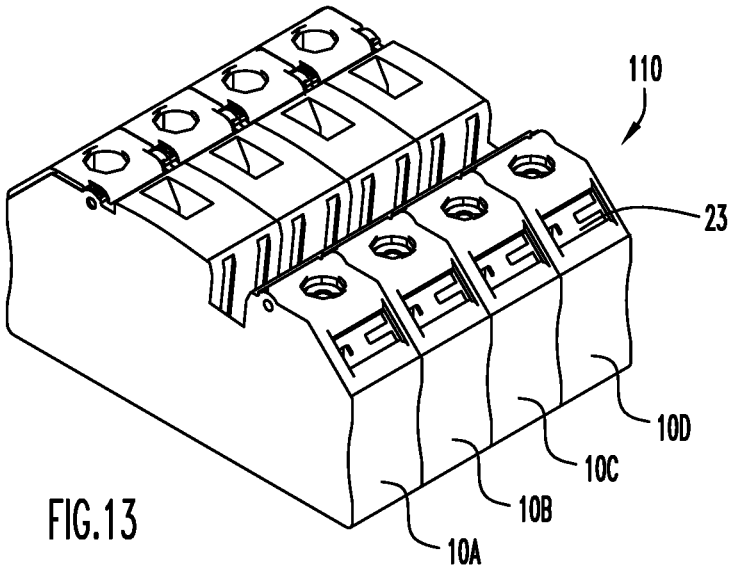
FIG. 13 is a feed-through terminal block formed from four of the feed-through terminal block modules shown in FIG. 1.
Figure 14:
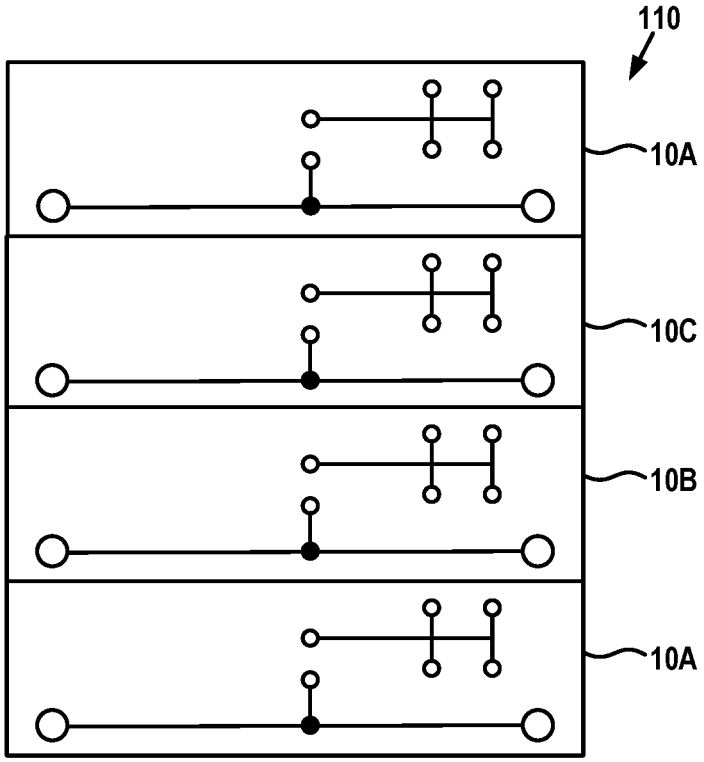
FIG. 14 is an electrical schematic view of the feed-through terminal block shown in FIG. 13.

Multiple feed-through terminal block modules 10 can be used to form a terminal block such as the modular feed-through terminal block 110 shown in FIGS. 13 and 14. The terminal block 110 includes four side-by-side modules 10A, 10B, 10C, 10D. A label can be placed on each module label surface 23 to identify, for example, the lines to be connected to that particular module.

Described below are illustrative uses of feed-through terminal blocks formed from multiple modules 10. The illustrated terminal blocks utilize the contacts 64*a*, 64*b* to bridge adjacent pairs of modules. The contacts 66*a*, 66*b* could be used instead, or a mix of contacts 64, 66 could be used. Contacts 64, 66 not used for bridging may be used for connecting test probes or the like into circuits connected to the terminal blocks.

Figure 15:
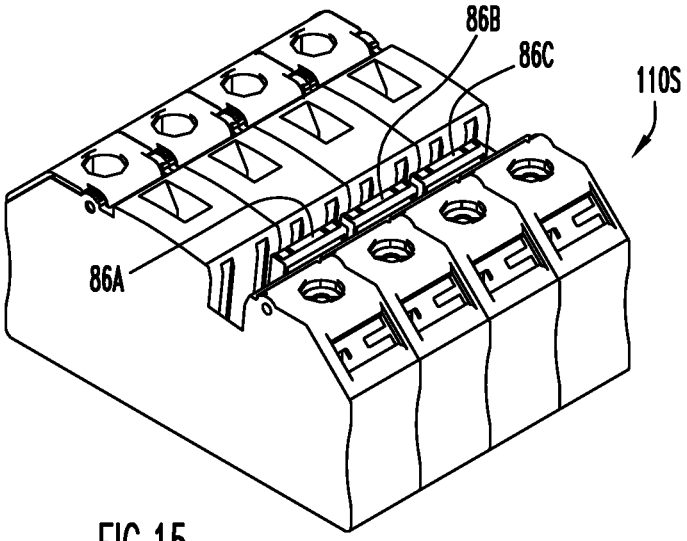
FIG. 15 is a view similar to FIG. 13 with bridge pins connecting adjacent pairs of feed-through terminal block modules.
Figure 16:
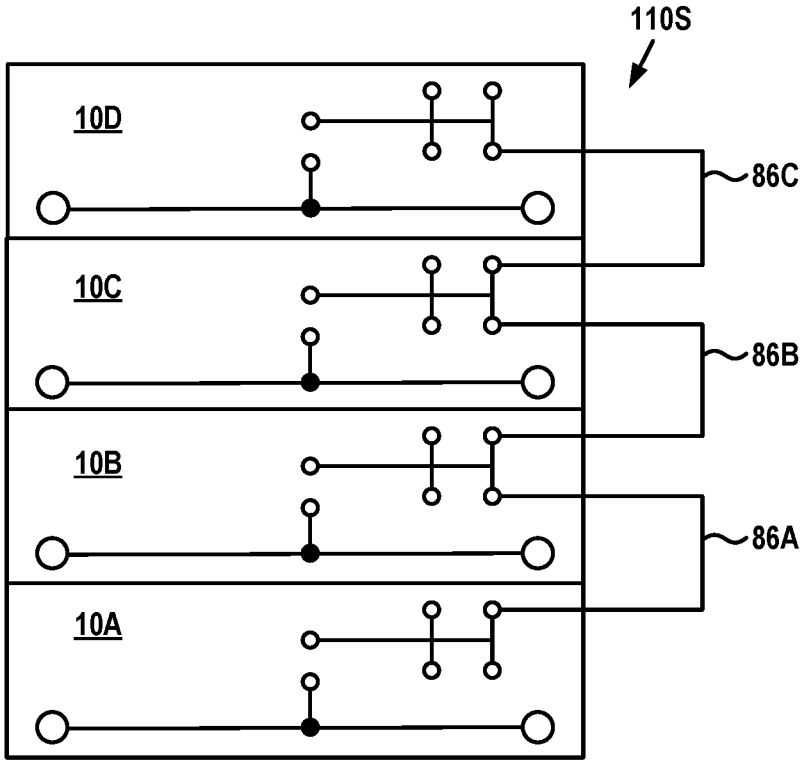
FIG. 16 is an electrical schematic view of the feed-through terminal block as shown in FIG. 15.

FIGS. 15 and 16 illustrates the modular terminal block 110 configured as a shorting block 110S. Individual bridge pins 86A, 86B, 86C serially bridge together each second current bar 30 of the modules.

Figure 17:
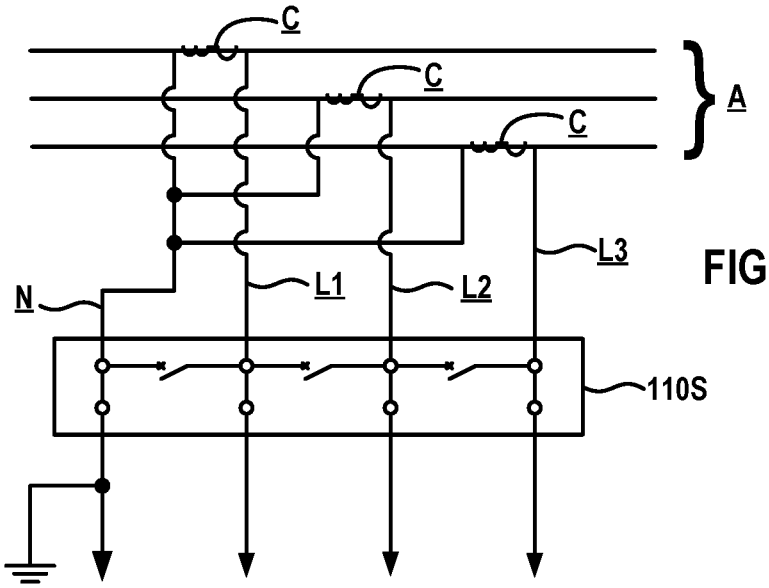
FIG. 17 is an electrical schematic view of the feed-through terminal block shown in FIG. 15 used as a short-circuit terminal block for protecting three current transformers.
Figure 18:
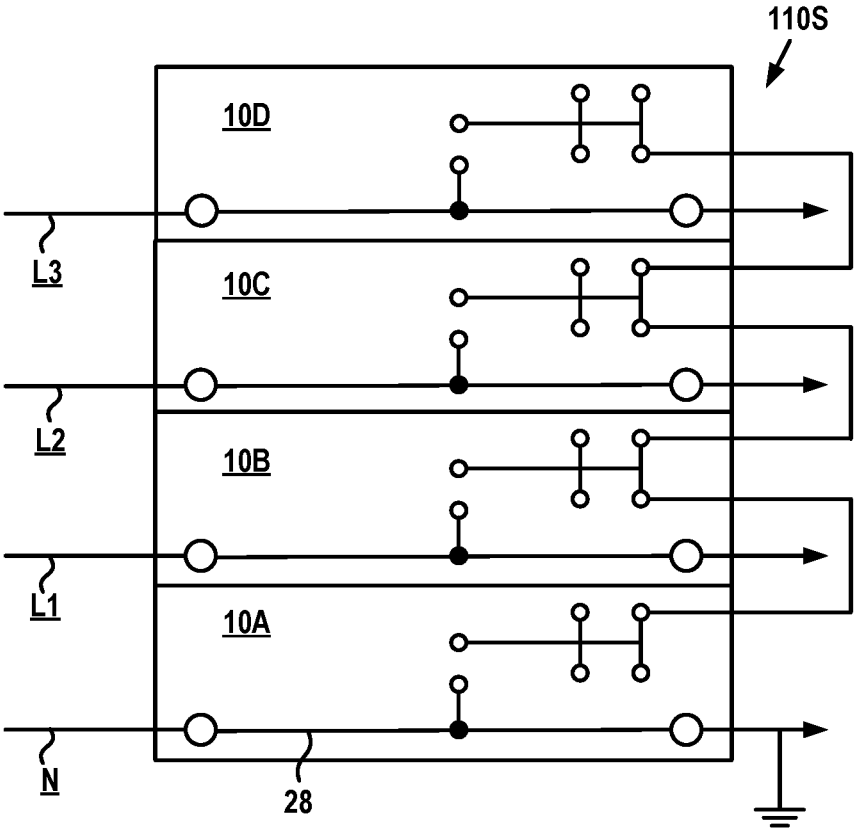
FIG. 18 is an enlarged electrical schematic view of the short-circuit terminal block shown in FIG. 17.

FIGS. 17 and 18 illustrates use of the shorting block 110S to protect three current transformers C connected to respective lines of a three-phase power line A. The transformers C are connected to a common ground or neutral line N that is connected to the first electrical terminal 24 and the second electrical terminal 26 of the module 10A. The first current bar 28 of the module 10A is therefore connected to ground.

Each transformer C is connected by respective transformer lines L1, L2, and L3 to the electrical terminals of a respective module 10B, 10C, 10D. The transformer lines L1, L2, L3 extend to relays (not shown) in a conventional manner.

The shorting block 110S is shown in FIGS. 17 and 18 during normal operation of the current transformers C. The bridge pins 86A, 86B, 86C electrically connect the second current bars 30 of the modules 10A, 10B, 10C, 10D with one another. The second current bar 30 of each of the modules 10A, 10B, 10C, 10D is not electrically connected to the first current bar 28 of the module. The transformer lines L1, L2, L3 extend through the first current bar 28 of each respective module 10B, 10C, 10D without being shorted to ground.

If desired, a contact plug 70 may be inserted into the module 10A that connects all the second current bars 30 of the shorting block 110S to ground or neutral during normal operation of the current transformers C.

Figure 19:
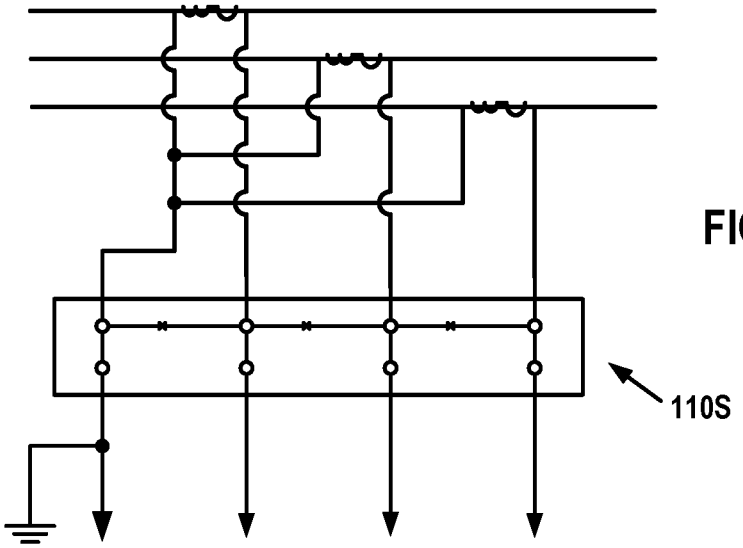
FIG. 19 is similar to FIG. 17 with the short-circuit terminal block shorting the three current transformers.
Figure 20:
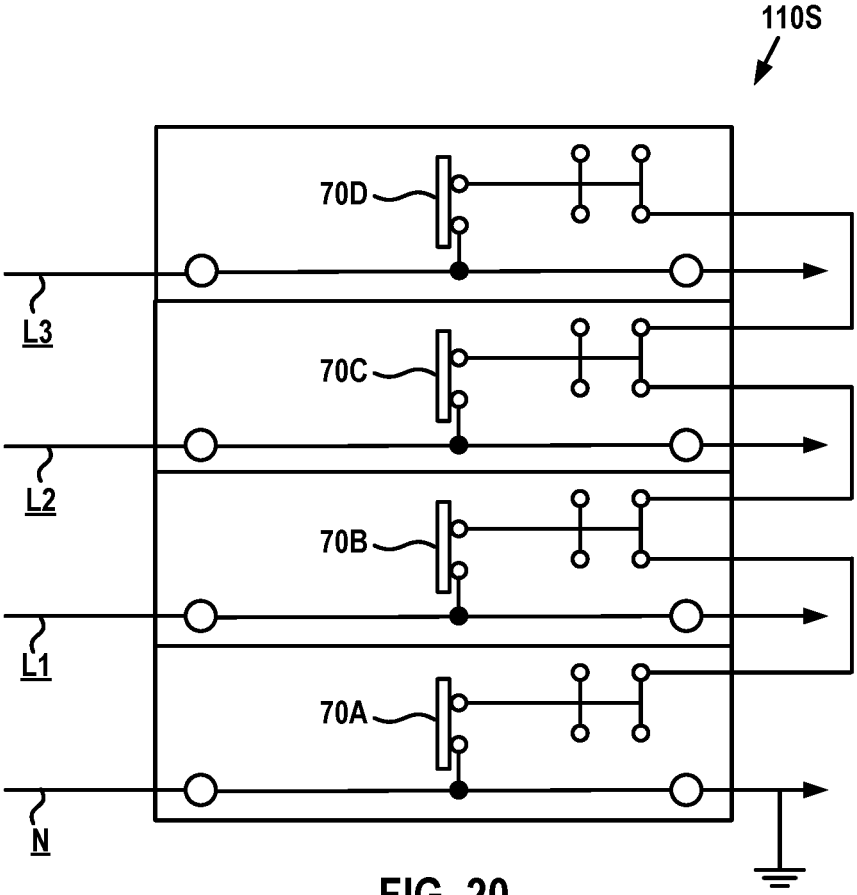
FIG. 20 is an enlarged electrical schematic view of the short-circuit terminal block shown in FIG. 19 with contact plugs connecting the first and second current bars of the terminal block modules.

FIGS. 19 and 20 illustrate the shorting block 110S with contact plugs 70 inserted in each of the modules 10A, 10B, 10C, 10D. The contact plug in each module electrically connects the first current bar 28 to the second current bar 30 of the module, thereby shorting all the transfer lines C to ground.

Figure 21:
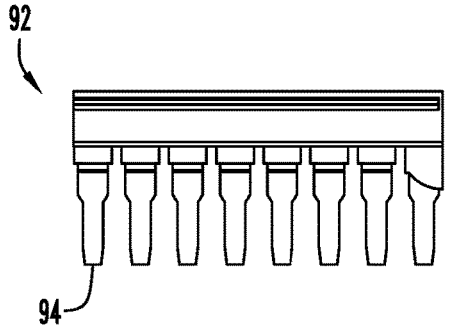
FIG. 21 is a front view of a ganged bridge pin for use with the short-circuit terminal block shown in FIG. 17.

Instead of individual bridge pins 86 to bridge adjacent pairs of modules, a ganged bridge pin having a sufficient number of electrically connected individual legs can be used to bridge the modules. For example, the ganged bridge pin 92 shown in FIG. 21 has eight legs 94 and can be used to bridge the modules 10 of the shorting block 110S (the outer two legs of the ganged bridge pin 92 are redundant when used with the shorting block 110S).

Figure 22:
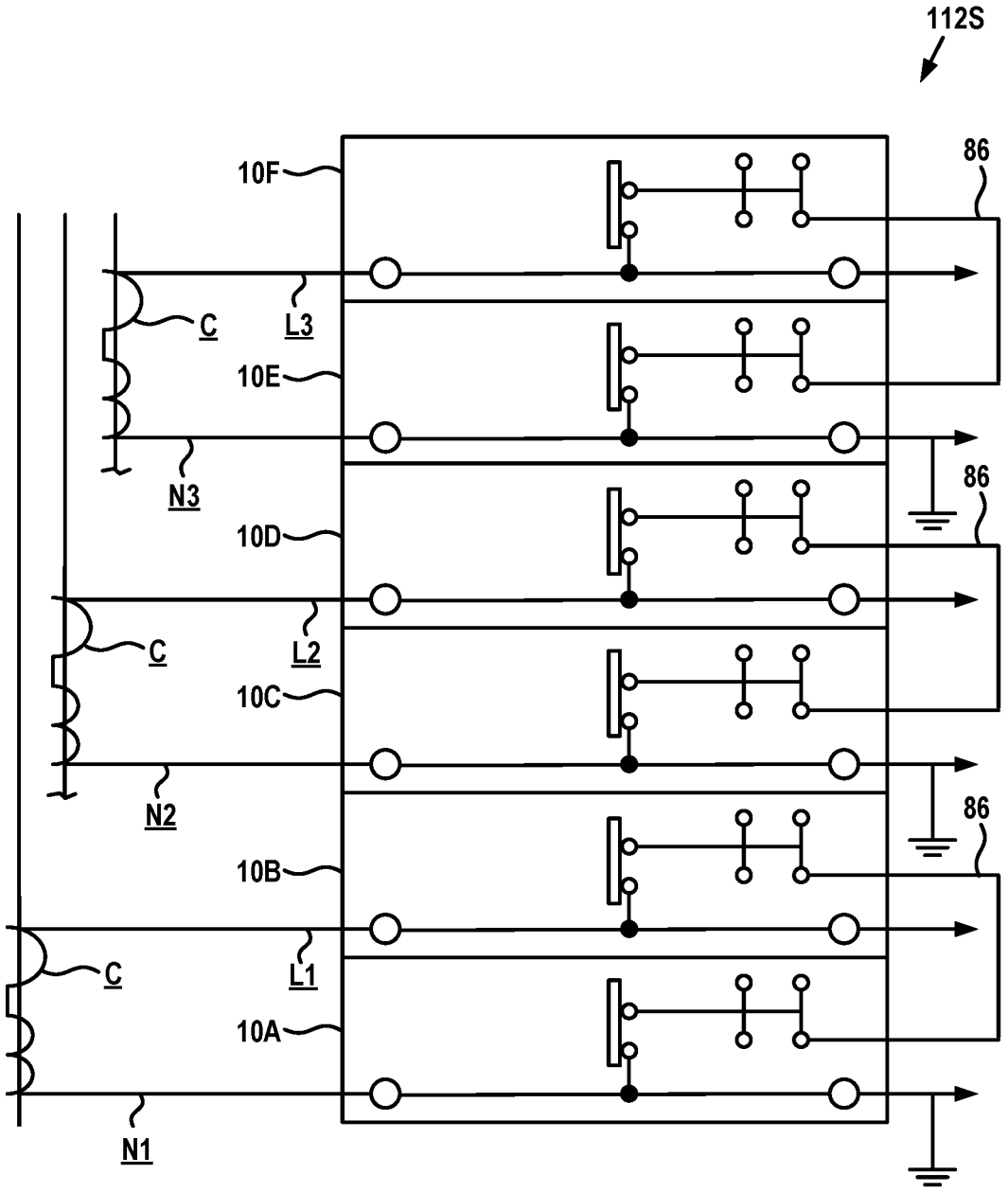
FIG. 22 is an electrical schematic view of a second embodiment feed-through terminal block formed from six of the feed-through terminal block modules shown in FIG. 1, the feed-through terminal block installed as a short-circuit terminal block and short-circuiting shorting three current transformers.

In FIG. 17, the current transformers C are connected to a common ground or neutral line. FIG. 22 illustrates the current transformers C being connected to individual ground or neutral lines N1, N2, N3. FIG. 22 also illustrates use of a shorting block 112S made of three pairs of feed-through terminal block modules 10A and 10B, 10C and 10D, and 10E and 10F that protects the current transformers. The neutral line N and the transformer line L of each respective current transformer C is connected to a respective pair of modules 10A and 10B, 10C and 10D, and 10E and 10F.

FIG. 22 illustrates the shorting block 112S shorting the transformer line L to the neutral line N of each respective current transformer C. A bridge pin 86 associated with each pair of modules bridges the second current bars of the pair of modules. The contact plug 70 inserted in each module of the pairs of modules electrically connect the first current bar 28 to the second current bar 30 of the module, shorting the transformer line L to the neutral line N of the current transformer C connected to the pair of modules.

A ganged bridge pin having three electrically isolated pairs of electrically connected legs can also be designed to short the pairs of modules.

Figure 23:
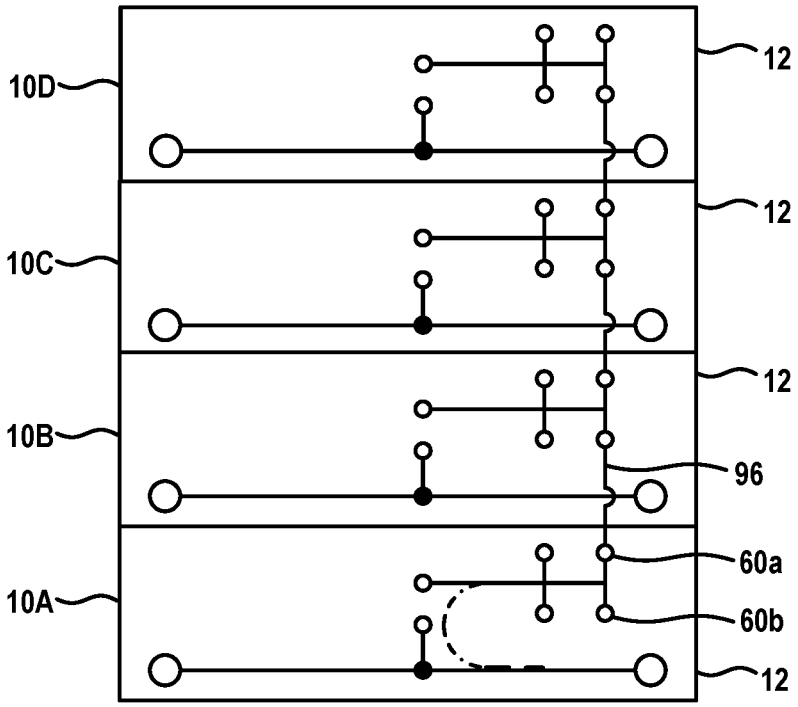
FIG. 23 is a third embodiment feed-through terminal block formed from four second embodiment feed-through terminal block modules and having an internal bridging current bar that bridges adjacent pairs of feed-through terminal block modules.
Figure 24:
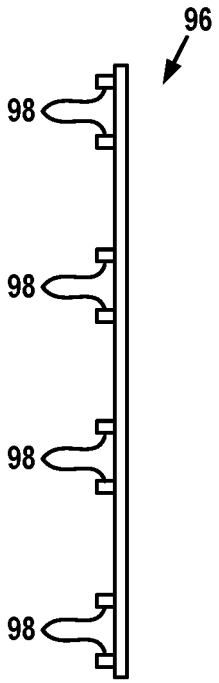
FIG. 24 is a side view of the internal bridging current bar of the feed-through terminal block shown in FIG. 23.

FIG. 23 illustrates a third embodiment shorting block 114S that is similar to the shorting block 110S. The shorting block 114S is formed from four side-by-side feed-through terminal block modules 10A, 10B, 10C, 10D. The terminal housing 12 of each module 10 has been modified to enable a shorting current bar 96 to permanently electrically connect the second current bars 30 of the modules with one another. The shorting current bar 96 has legs 98 that are received into the through-holes 60*a*, 60*b* of each second current bar to mechanically and electrically connect the shorting current bar to each second current bar.

This design of a feed-through terminal block eliminates the need for externally exposed bridge pins, and the design of the individual modules 10 can be modified to eliminate external access to the holes 60*a*, 60*b*. Access to the other through holes 62*a*, 62*b* of the module may be retained if desired.

In a modification of the shorting block 114S, the module 10A is dedicated for attaching to a ground line. The second current bar 30 of the module 10A is permanently connected to the first current bar 28 as shown in broken lines in FIG. 23. The first and second contact portions of the module 10A can be eliminated, as can the housing opening 52.

Figure 25:
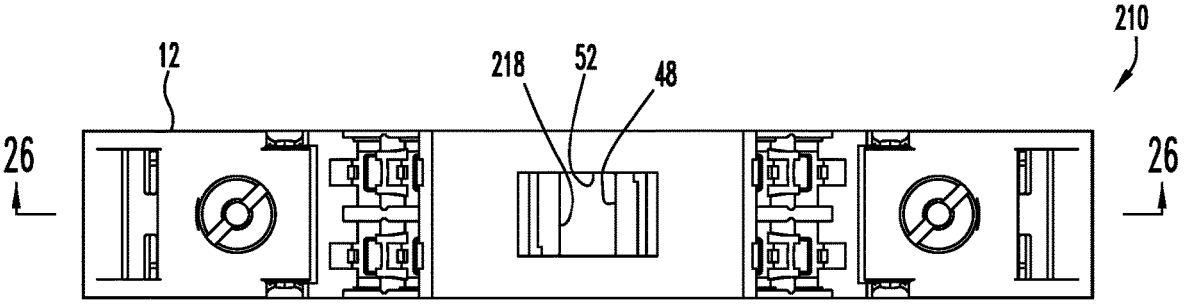
FIG. 25 is a top view of a third embodiment of the disclosed feed-through terminal block module.
Figure 26:
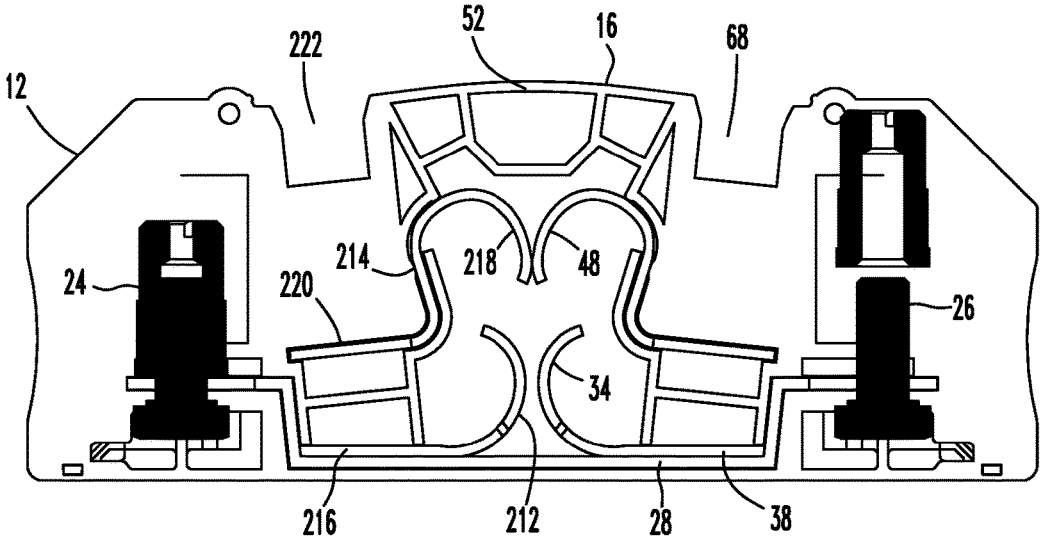
FIG. 26 is a vertical sectional view taken along line 26-26 of FIG. 25.

FIGS. 25 and 26 illustrate a second embodiment feed-through terminal block module 210. Only differences between the first embodiment module 10 and the second embodiment module 210 will be discussed. The same reference numbers will be used to refer to common elements of the two embodiments.

The module 210 includes a fourth contact portion 212 of the module and a third current bar 214 that includes a fifth contact portion and a sixth contact portion of the module 210. The first electrical terminal 24 and the second electrical terminal 26 are spaced further apart from one another and the terminal housing 12 is widened to contain the third current bar 214.

The fourth contact portion 212 is part of the first current bar 28 and is formed from a third metal strip 216 connected to the first metal strip 36. The third metal strip 216 is identical to the second metal strip 38 but is disposed on the first metal strip mirror-symmetric on an opposite side of a vertical plane extending between the contact noses of the first and fourth contact portions. The contact noses of the first contact portion and the fourth contact portion 212 are spaced apart and separated by an air gap when the contact portions are unstressed.

The third current bar 214 is identical to the second current bar 30 but is disposed in the terminal housing 12 mirror-symmetric along the vertical axis with the second current bar 30. The third current bar 214 includes a fifth contact portion 218 like the second contact portion 46 and a sixth contact portion 220 like the third contact portion 48. The contact noses of the second contact portion 46 and the fifth contact portion 218 are disposed immediately adjacent one another. Alternatively, the contact noses can be separated by an air gap or could press against one another utilizing spring force.

The housing opening 52 is centered over the contact noses of the second contact portion 46 and the fifth contact portion 218. The top wall 16 of the terminal housing 12 is mirror symmetric about a vertical plane extending along the contact portions mirror axis to define a recess 222 like the recess 68 for providing external access to the contacts of the sixth contact portion 220.

The module 210 is designed to successively receive a contact plug such as the contact plug 70 inserted through the housing opening 52 first between the second and fifth contact portions and then between the first and fourth contact portions. When fully inserted the contact plug electrically connects the first current bar with both the second and third current bars. The plug elastically deflects the contact portions to provide swiping reliable electrical contact between the plug contacts and the contact noses of the contact portions as previously described. Because the contact plug is received between and squeezed between succeeding pairs of contact portions that assist in guiding the contact plug into the housing, the vertical wall 54 found in the module 10 is eliminated in the module 210.

Figure 27:
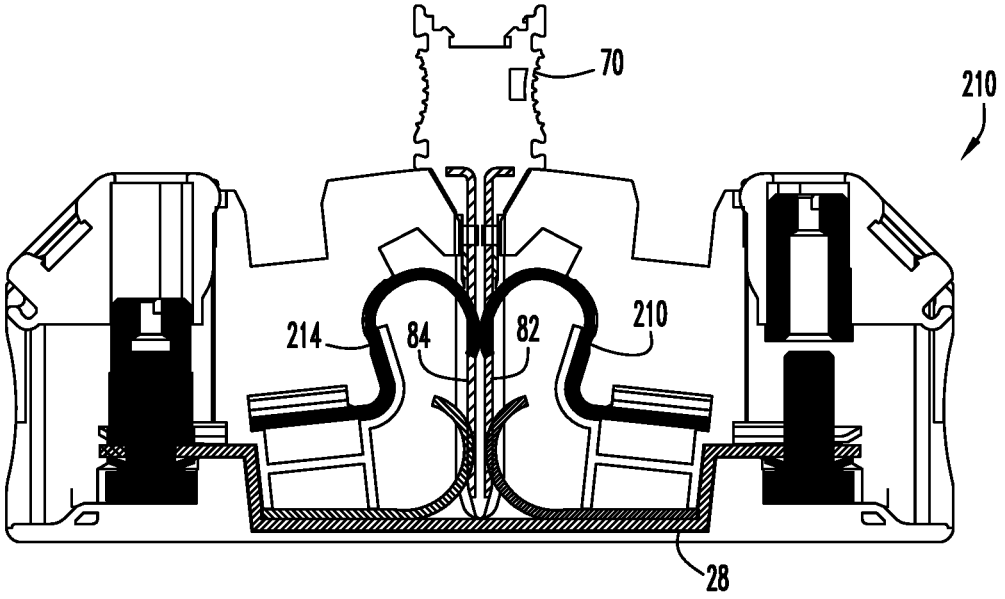
FIG. 27 is a view similar to FIG. 26 but with a contact plug fully inserted into the terminal housing.

FIG. 27 illustrates a contact plug 70 fully inserted into the feed-through terminal block module 210. The contact plug as shown in FIG. 27 electrically connects the first current bar 28 with both the second current bar 30 and the third current bar 214.

The contact plug 70 has opposed first plug electrical contact 82 and second plug electrical contact 84 as previously described. The plug electrical contact 82 sequentially electrically connects with the contact noses of the first current bar 28 and second current bar 30 as previously described with respect to the module 10. The plug electrical contact 84 electrically sequentially connects with the contact noses of the first current bar 28 and the third current bar 214 in a like manner.

The illustrated feed-through terminal blocks are not intended to be limiting. Terminal blocks may be made of a different number of feed-through terminal block modules than the illustrated terminal blocks. The terminal block modules may be designed for mounting on a different mounting structure. Terminal blocks may be designed to have a mix of internal and external bridging.

While one or more embodiments have been disclosed and described in detail, it is understood that this is capable of modification and that the scope of the disclosure is not limited to the precise details set forth but includes modifications obvious to a person of ordinary skill in possession of this disclosure, including (but not limited to) changes in contact nose shape, material selection, size, operating ranges (temperature, current capacity, and the like), environment of use, and also such changes and alterations as fall within the purview of the following claims.

What is claimed is:

1. A feed-through terminal block module comprising:

a terminal housing;

a pair of electrical terminals, a first current bar, and a second current bar each being disposed in an interior of the terminal housing, the second current bar being spaced away from the first current bar and the pair of electrical terminals;

the first current bar being a unitary member comprising a feed-through portion and a first contact portion connected to the feed-through portion, the feed-through portion comprising a pair of terminal portions being fixedly connected to respective ones of the pair of electrical terminals, the feed-through portion permanently electrically connecting together the pair of electrical terminals, the first contact portion being spaced away from the feed-through portion;

the second current bar comprising a second contact portion and a third contact portion;

the first and second contact portions together defining a contact region of the housing spaced away from the feed-through portion of the first current bar, the first and second contact portions for simultaneously engaging a contact plug inserted into the terminal housing whereby the third contact portion is electrically connected through the contact plug with the feed-through portion of the first current bar and the feed-through portion of the first current bar maintains electrically connecting together the pair of electrical terminals; and the second current bar being electrically disconnected from both the first current bar and the pair of electrical terminals when the contact plug is not in the terminal housing.

2. The feed-through terminal block module of claim 1 wherein the pair of electrical terminals are spaced apart from one another and define a first axis extending through the pair of electrical terminals, and the first and second contact portions define a second axis substantially perpendicular to the first axis.

3. The feed-through terminal block module of claim 1 wherein each of the first and second contact portions face an air gap, the air gap extending from the first contact portion to beyond the second contact portion.

4. The feed-through terminal block module of claim 3 wherein the first and second contact portions each comprise a contact nose, the contact noses facing the air gap.

5. The feed-through terminal block module of claim 4 wherein each of the first and second contact portions is elastically displaceable between an unstressed position wherein the contact nose is disposed along the air gap and a stressed position wherein the contact nose is displaced away from the air gap.

6. The feed-through terminal block module of claim 3 wherein the air gap extends to the feed-through portion of the first current bar, the second contact portion being disposed along the air gap between the third contact portion and the said feed-through portion.

7. The feed-through terminal block module of claim 3 wherein the terminal housing comprises an interior wall facing the first and second contact portions, the interior wall spaced from the first and second contact portions by the air gap.

8. The feed-through terminal block module of claim 7 wherein the interior wall comprises a pair of spaced apart ribs facing the first and second contact portions, the ribs extending into the air gap.

9. The feed-through terminal block module of claim 1 wherein the first current bar is formed of first and second individual metal strips connected to one another and electrically conductive with one another, the first metal strip forming the feed-through portion and the second metal strip forming the first contact portion.

10. The feed-through terminal block module of claim 1 wherein the first contact portion is located on a free end portion of the first current bar and the second contact portion is located on a free end portion of the second current bar.

11. The feed-through terminal block module of claim 1 wherein the third contact portion comprises a pair of through holes; and each of the through holes being a receiver for a leg of a respective plug-in jumper.

12. The feed-through terminal block module of claim 1 wherein the terminal housing comprises an outer wall having an opening that opens into the terminal housing, the second contact portion being disposed between the opening and the first contact portion;

a contact plug inserted into the terminal housing and extending through the opening, the contact plug comprising an insulated body and an electrical contact disposed on the body, the electrical contact simultaneously engaging and electrically connecting the first and second contact portions.

13. The feed-through terminal block module of claim 12 wherein the insulated body comprises a handle and a plug extending from the handle, the electrical contact is disposed on the plug, and the electrical contact is spaced away from the handle;

the electrical contact first contacting the second contact portion and then contacting the first contact portion when the contact plug in an uninserted state is inserted into the terminal housing;

the electrical contact of the contact plug is spaced from the handle a sufficient distance that the entire electrical contact is disposed inside of the terminal housing before the electrical contact engages the first contact portion during insertion of the contact plug through the opening and into the terminal housing.

14. The feed-through terminal block module of claim 1 wherein the first current bar comprises a fourth contact portion connected to the feed-through portion, the fourth contact portion being disposed mirror-symmetrically with the first contact portion, the fourth contact portion facing the first contact portion, the fourth contact portion and the first contact portion for receiving a contact plug therebetween that electrically connects the fourth contact portion with the first contact portion when the contact plug is inserted into the terminal housing.

15. The feed-through terminal block module of claim 14 wherein the fourth contact portion contacts the first contact portion when the contact plug is not in the terminal housing, the first and fourth contact portions being elastically deformable away from one another to receive the contact plug therebetween.

16. The feed-through terminal block module of claim 1 comprising a third current bar spaced away from both of the first and second current bars, the third current bar comprising a fourth contact portion and a fifth contact portion, the third current bar being disposed mirror symmetrically with the second current bar, the second contact portion of the second current bar facing the fourth contact portion of the third current bar for receiving a contact plug therebetween when the contact plug is inserted into the terminal housing.

17. The feed-through terminal block module of claim 16 wherein the second and fourth contact portions are spaced apart by an air gap when the contact plug is not in the terminal housing.

18. The feed-through terminal block module of claim 16 wherein the second and fourth contact portions are elastically deformable away from one another to receive the contact plug therebetween.

19. The feed-through terminal block module of claim 16 wherein each of the third contact portion and the fifth contact portion comprises at least one through-hole, each at least one through hole being a receiver for a leg of a respective plug-in jumper.

20. The feed-through terminal block module of claim 1 comprising a third current bar spaced away from the pair of electrical terminals, the first current bar, and the second current bar;

the first current bar comprises a fourth contact portion connected to the feed-through portion and spaced from the first contact portion;

the fourth contact portion being disposed mirror-symmetrically with the first contact portion, the first and fourth contact portions facing each other to receive a contact plug therebetween and simultaneously engaging the contact plug when the contact plug is inserted into the terminal housing;

the third current bar comprises a fifth contact portion and a sixth contact portion, the third current bar being disposed mirror symmetrically with the second current bar, the second contact portion facing the fifth contact portion to receive the contact plug therebetween and simultaneously engage the contact plug when the contact plug is inserted into the terminal housing.

21. A terminal block formed from a plurality of feed-through terminal block modules, each terminal block module comprising:

a terminal housing;

a pair of electrical terminals, a first current bar, and a second current bar, each being disposed in the housing, the second current bar being spaced away from the first current bar and the pair of electrical terminals;

the first current bar being a unitary member comprising a feed-through portion and a first contact portion connected to the feed-through portion, the feed-through portion comprising a pair of terminal portions being fixedly connected to respective ones of the pair of electrical terminals, the feed-through portion permanently electrically connecting together the pair of electrical terminals, the first contact portion being spaced away from the feed-through portion;

the second current bar comprising a second contact portion and a third contact portion;

the first and second contact portions together defining a contact region of the housing spaced away from the feed-through portion of the first current bar, the first and second contact portions for simultaneously engaging a contact plug inserted into the terminal housing whereby the third contact portion is electrically connected through the plug with the feed-through portion of the first current bar and thereby to the pair of electrical terminals;

the second current bar being electrically disconnected from both the first current bar and the pair of electrical terminals when the contact plug is not in the terminal housing; and one or more jumpers, each jumper having at least two legs, each leg engaged with a respective fourth contact portion of the terminal block whereby the respective fourth contact portions are electrically connected with one another.

22. The terminal block of claim 21 wherein each respective feed-through terminal block module engaged with a leg of the said one or more jumpers has a respective contact plug plugged into the contact region of the respective module, the contact plug simultaneously engaging and electrically connecting the first and second contact portions of the respective module whereby the feed-through portion and the leg engaging the fourth contact portion of the respective module are electrically connected with one another.

23. The terminal block of claim 21 comprising a fixed common current bar disposed inside the terminal block;

the common current bar engaging the fourth contact portions of the plurality of feed-through terminal block housing modules whereby the common current bar permanently electrically connects all of the fourth contact portions with one another.

24. The terminal block of claim 23 comprising a respective contact plug inserted into the contact region of one or more of the plurality of feed-through terminal blocks, each contact plug engaged with and electrically connecting the first and second contact portions of the respective module whereby the feed-through portion of the respective module is electrically connected with the common current bar.

* * * * *